US009890584B1

(12) United States Patent
Chen

(10) Patent No.: US 9,890,584 B1
(45) Date of Patent: Feb. 13, 2018

(54) CORDLESS MAGNETICALLY ATTRACTIVE SHADE ASSEMBLY

(71) Applicant: My Home Global Company, ErShui Township, ChangHua County (TW)

(72) Inventor: Ju-Huai Chen, ErShui Township (TW)

(73) Assignee: My Home Global Company, Ershui Township (TW)

( * ) Notice: Subject to any disclaimer, the term of this patent is extended or adjusted under 35 U.S.C. 154(b) by 0 days.

(21) Appl. No.: 15/603,535

(22) Filed: May 24, 2017

(51) Int. Cl.
*E06B 9/24* (2006.01)

(52) U.S. Cl.
CPC ..... *E06B 9/24* (2013.01); *E06B 2009/2405* (2013.01); *E06B 2009/2452* (2013.01)

(58) Field of Classification Search
CPC .... E06B 9/24; E06B 9/262; E06B 2009/2405; E06B 2009/2423; E06B 2009/2452; E06B 2009/2622; E06B 2009/2625; E06B 2009/2441
See application file for complete search history.

(56) References Cited

U.S. PATENT DOCUMENTS 7,150,304 B2 * 12/2006 Hsu ..... E06B 9/262 160/348
2012/0102707 A1 * 5/2012 Chen ..... E06B 9/262 29/428
2012/0234502 A1 * 9/2012 Chen ..... E06B 9/262 160/84.01
2016/0120352 A1 * 5/2016 Hsu ..... E06B 9/262 160/201
2016/0376838 A1 * 12/2016 Hsu ..... E06B 9/28 160/84.03
2017/0138121 A1 * 5/2017 Hsu ..... E06B 9/262
2017/0218693 A1 * 8/2017 Hsu ..... E06B 7/28 49/380

* cited by examiner

*Primary Examiner* — Blair M Johnson
(74) *Attorney, Agent, or Firm* — Alan D. Kamrath; Kamrath IP Lawfirm, P.A.

(57) ABSTRACT

A shade assembly includes a first shading unit, a plurality of second shading units detachably connected with the first shading unit and arranged at the bottom of the first shading unit, and a third shading unit detachably connected with the first shading unit and arranged at the front face of the first shading unit. Thus, the shade cloth of each of the second shading units and the shade cloth of the third shading unit are expanded and folded to regulate the shading effect and the indoor brightness.

10 Claims, 13 Drawing Sheets

CORDLESS MAGNETICALLY ATTRACTIVE SHADE ASSEMBLY

BACKGROUND OF THE INVENTION

1. Field of the Invention

The present invention relates to a window covering and, more particularly, to a cordless magnetically attractive shade assembly.

2. Description of the Related Art

A conventional roman shade comprises a headrail, a shading member mounted on and extended from the headrail, a plurality of transverse rods mounted on the shading member, and a lift cord extended through the shading member and secured to the bottom of the shading member to move the shading member upward and downward. When the lift cord is pulled, the transverse rods are driven and moved to roll or expand the shading member. Thus, the bottom of the shading member is lifted and folded by the lift cord to allow passage of the solar rays and is lowered and expanded by the lift cord to provide a shading effect. However, the lift cord depends from a side of the roman shade so that the lift cord is easily tangled with a child's neck during playing, thereby causing danger to the child. In addition, when the shading member is fully expanded, the solar rays cannot penetrate the shading member so that the indoor light is too weak, and when the shading member is fully folded, the solar rays directly irradiate the indoor room so that the indoor light is too strong.

BRIEF SUMMARY OF THE INVENTION

In accordance with the present invention, there is provided a shade assembly comprising a first shading unit, a plurality of second shading units detachably connected with the first shading unit, and a third shading unit detachably connected with the first shading unit. The first shading unit includes a light permeation cloth having a top provided with a tubular portion which has a first mounting sleeve and a second mounting sleeve, a magnet structure mounted in the second mounting sleeve, a first connecting member mounted on a bottom of the light permeation cloth, and a second connecting member mounted on a rear face of the light permeation cloth and corresponding to the second mounting sleeve of the tubular portion. Each of the second shading units includes a shade cloth having a bottom provided with a tubular portion, a matching member mounted on a top of the shade cloth and detachably connected with the first connecting member of the first shading unit, a plurality of mounting sleeves mounted on the shade cloth and arranged under the matching member, a plurality of magnet structures mounted in the mounting sleeves respectively, a weight pole mounted in the tubular portion of the shade cloth, and a metal element mounted in one of the mounting sleeves and arranged between the magnet structures and the weight pole. The metal element is magnetically attracted by the magnet structures. The third shading unit includes a shade cloth having a top provided with a first tubular portion and a bottom provided with a second tubular portion, a magnet structure mounted in the first tubular portion of the shade cloth and magnetically attracted with the magnet structure of the first shading unit, a weight pole mounted in the second tubular portion of the shade cloth, at least one connecting member mounted on the top of the shade cloth, and at least one matching member mounted on the bottom of the shade cloth and detachably connected with the at least one connecting member.

According to the primary advantage of the present invention, the shade cloth of each of the second shading units and the shade cloth of the third shading unit are expanded and folded to regulate the shading effect and the indoor brightness.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
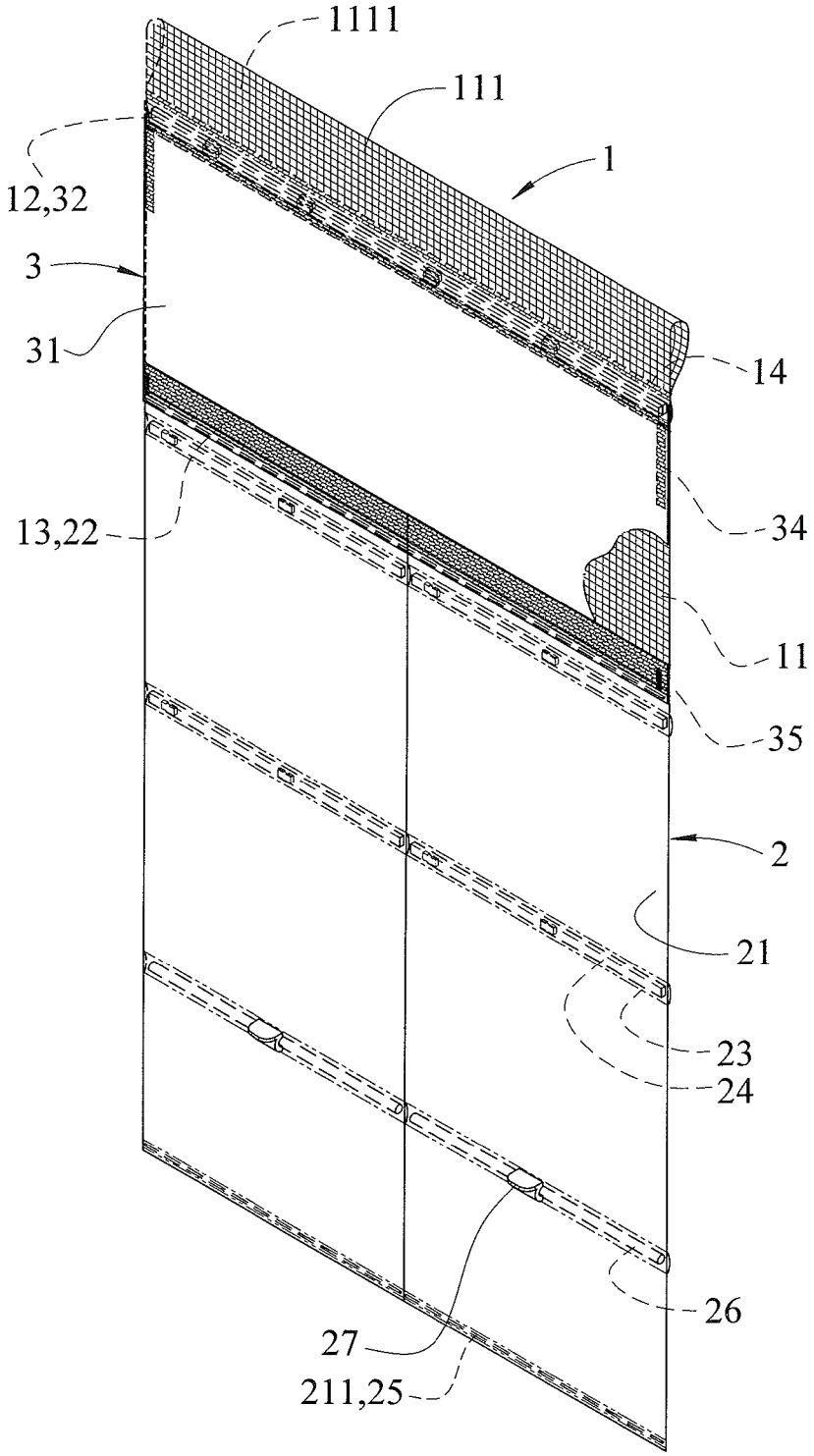
FIG. 1 is a perspective view of a shade assembly in accordance with the first preferred embodiment of the present invention.

Referring to the drawings and initially to FIGS. 1-6, a shade assembly in accordance with the preferred embodiment of the present invention comprises a first shading unit 1, a plurality of second shading units 2 detachably connected with the first shading unit 1, and a third shading unit 3 detachably connected with the first shading unit 1.

The first shading unit 1 includes a light permeation cloth 11 having a top provided with a tubular portion 111 which has a first mounting sleeve 1111 and a second mounting sleeve 1112, a magnet structure 12 mounted in the second mounting sleeve 1112, a first connecting member 13 mounted on a bottom of the light permeation cloth 11, and a second connecting member 14 mounted on a rear face of the light permeation cloth 11 and corresponding to the second mounting sleeve 1112 of the tubular portion 111. The top of the light permeation cloth 11 is encircled and sewn to form the tubular portion 111. The tubular portion 111 is sewn to form the first mounting sleeve 1111 and the second mounting sleeve 1112.

Each of the second shading units 2 includes a shade cloth 21 having a bottom provided with a tubular portion 211, a matching member 22 mounted on a top of the shade cloth 21 and detachably connected with the first connecting member 13 of the first shading unit 1, a plurality of mounting sleeves 23 mounted on the shade cloth 21 and arranged under the matching member 22, a plurality of magnet structures 24 mounted in the mounting sleeves 23 respectively, a weight pole 25 mounted in the tubular portion 211 of the shade cloth 21, and a metal element 26 mounted in one of the mounting sleeves 23 and arranged between the magnet structures 24 and the weight pole 25. The bottom of the shade cloth 21 is encircled and sewn to form the tubular portion 211. Each of the mounting sleeves 23 is made of cloth material and is sewn on the shade cloth 21. The weight pole 25 is made of plastic material. The metal element 26 is an elongate pole. The metal element 26 is magnetically attracted by the magnet structures 24.

The third shading unit 3 includes a shade cloth 31 having a top provided with a first tubular portion 311 and a bottom provided with a second tubular portion 312, a magnet structure 32 mounted in the first tubular portion 311 of the shade cloth 31 and magnetically attracted with the magnet structure 12 of the first shading unit 1, a weight pole 33 mounted in the second tubular portion 312 of the shade cloth 31, at least one connecting member 34 mounted on the top of the shade cloth 31, and at least one matching member 35 mounted on the bottom of the shade cloth 31 and detachably connected with the at least one connecting member 34 in a sticking member. The top of the shade cloth 31 is encircled and sewn to form the first tubular portion 311, and the bottom of the shade cloth 31 is encircled and sewn to form the second tubular portion 312. The weight pole 33 is made of plastic material.

Figure 5:
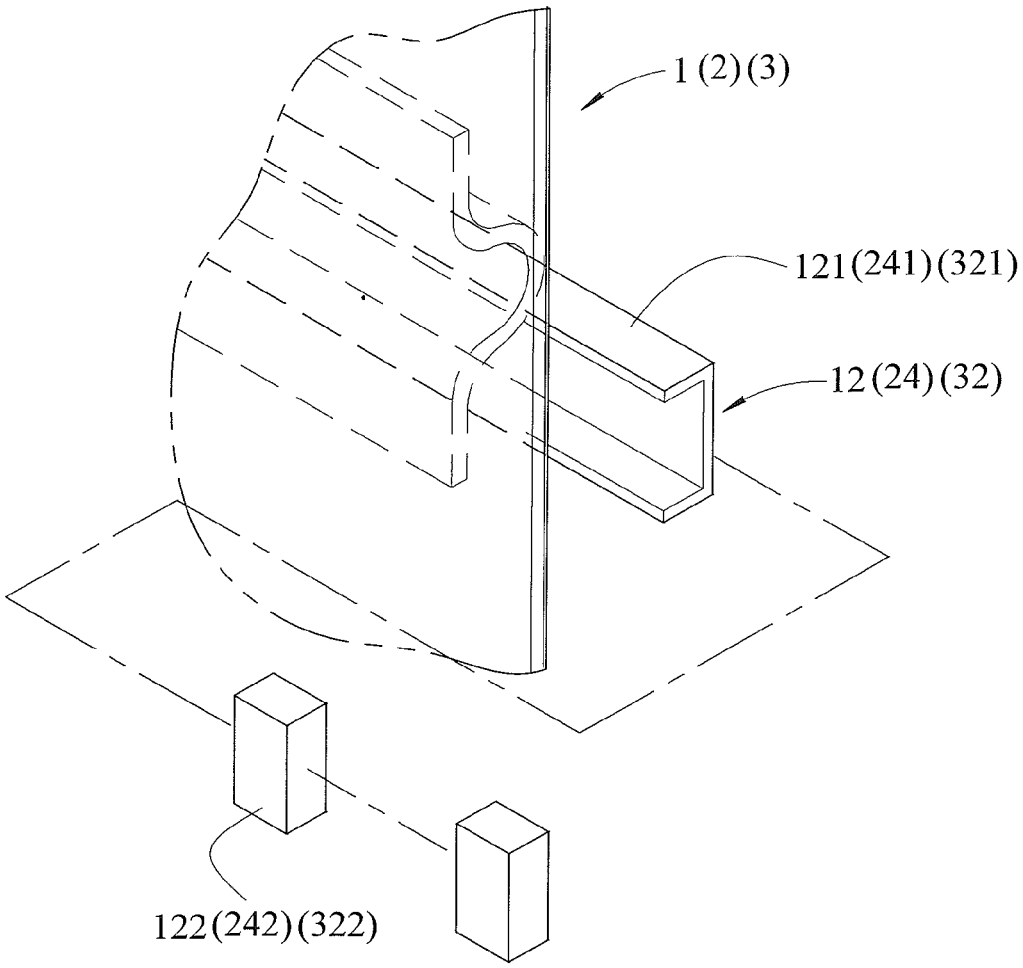
FIG. 5 is an exploded perspective view of a magnet structure of the shade assembly in accordance with the preferred embodiment of the present invention.

In the preferred embodiment of the present invention, each of the magnet structures 12, 24 and 32 of the first shading unit 1, each of the second shading units 2 and the third shading unit 3 includes a housing 121, 241 and 321, and at least one magnet 122, 242 and 322 mounted in the housing 121, 241 and 321 as shown in FIG. 5. The housing 121, 241 and 321 of each of the magnet structures 12, 24 and 32 is made of plastic or wood material and has an elongate shape. Preferably, the housing 121, 241 and 321 of each of the magnet structures 12, 24 and 32 is a U-shaped, hollow or C-shaped pipe.

Figure 6:
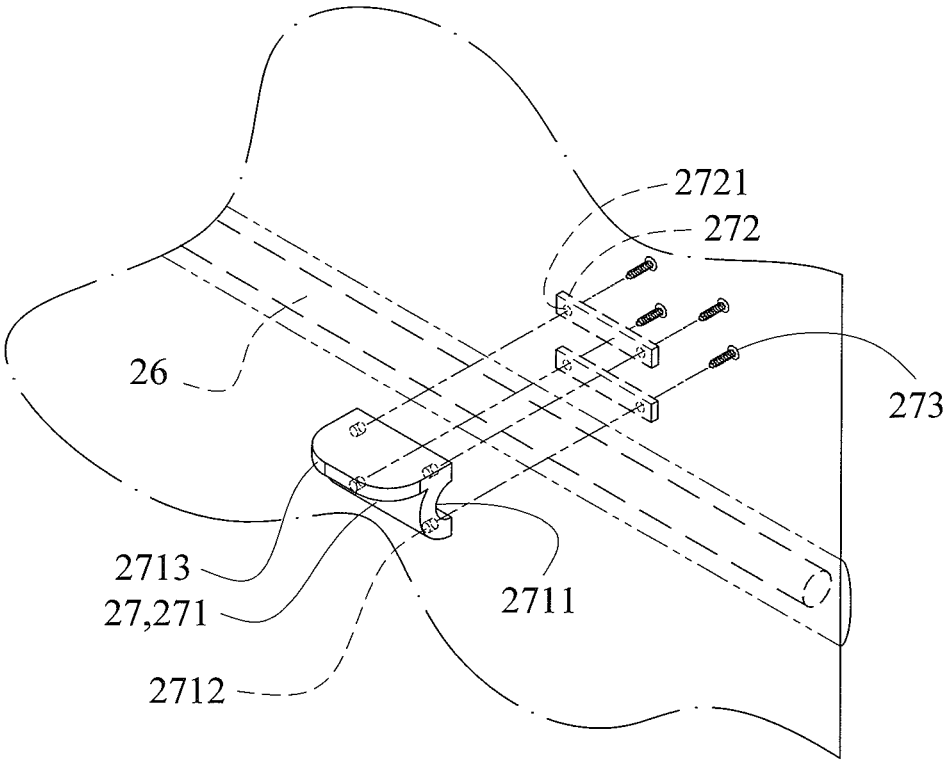
FIG. 6 is an exploded perspective view of an adjusting structure of the shade assembly in accordance with the preferred embodiment of the present invention.
Figure 7:
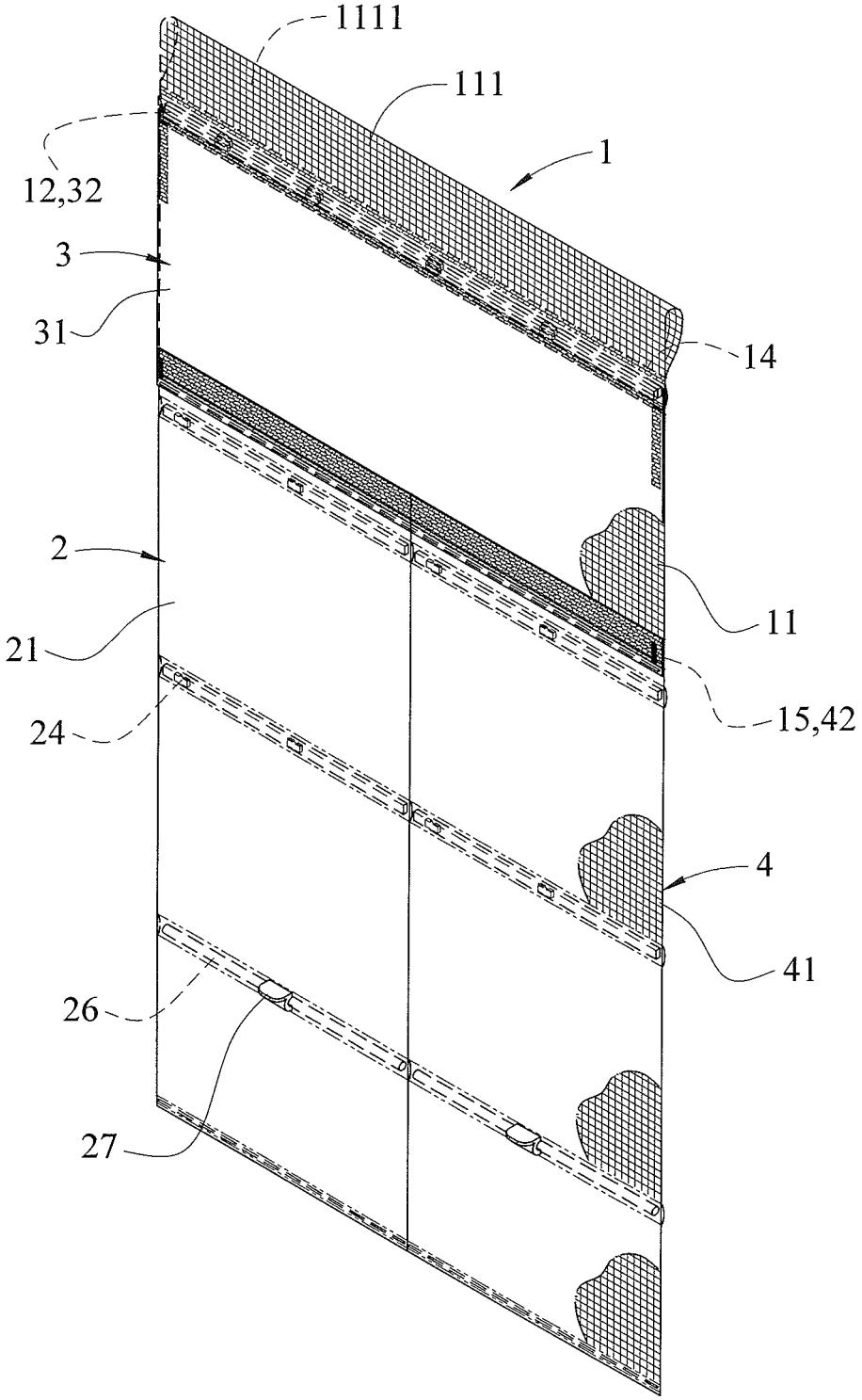
FIG. 7 is a perspective view of a shade assembly in accordance with the second preferred embodiment of the present invention.

In the preferred embodiment of the present invention, each of the second shading units 2 further includes an adjusting structure 27 mounted on the shade cloth 21 and corresponding to the metal element 26 to aid a user moving and adjust the position of the metal element 26. The adjusting structure 27 includes an adjusting piece 271 arranged on a front face of the shade cloth 21, two clamping pieces 272 arranged on a rear face of the shade cloth 21, and a plurality of fastening members 273 extending through the two clamping pieces 272 and the adjusting piece 271 to combine the two clamping pieces 272 with the adjusting piece 271 as shown in FIG. 6. The adjusting piece 271 has a first end provided with an arcuate abutting portion 2711 resting on the metal element 26 and a second end provided with an extension 2713. The adjusting piece 271 is provided with a plurality of screw bores 2712. Each of the two clamping pieces 272 is provided with a plurality of through holes 2721. The fastening members 273 extend through the through holes 2721 of the two clamping pieces 272 and are screwed into the screw bores 2712 of the adjusting piece 271.

In practice, the first shading unit 1, each of the second shading units 2 and the third shading unit 3 are connected in two modes.

Figure 2:
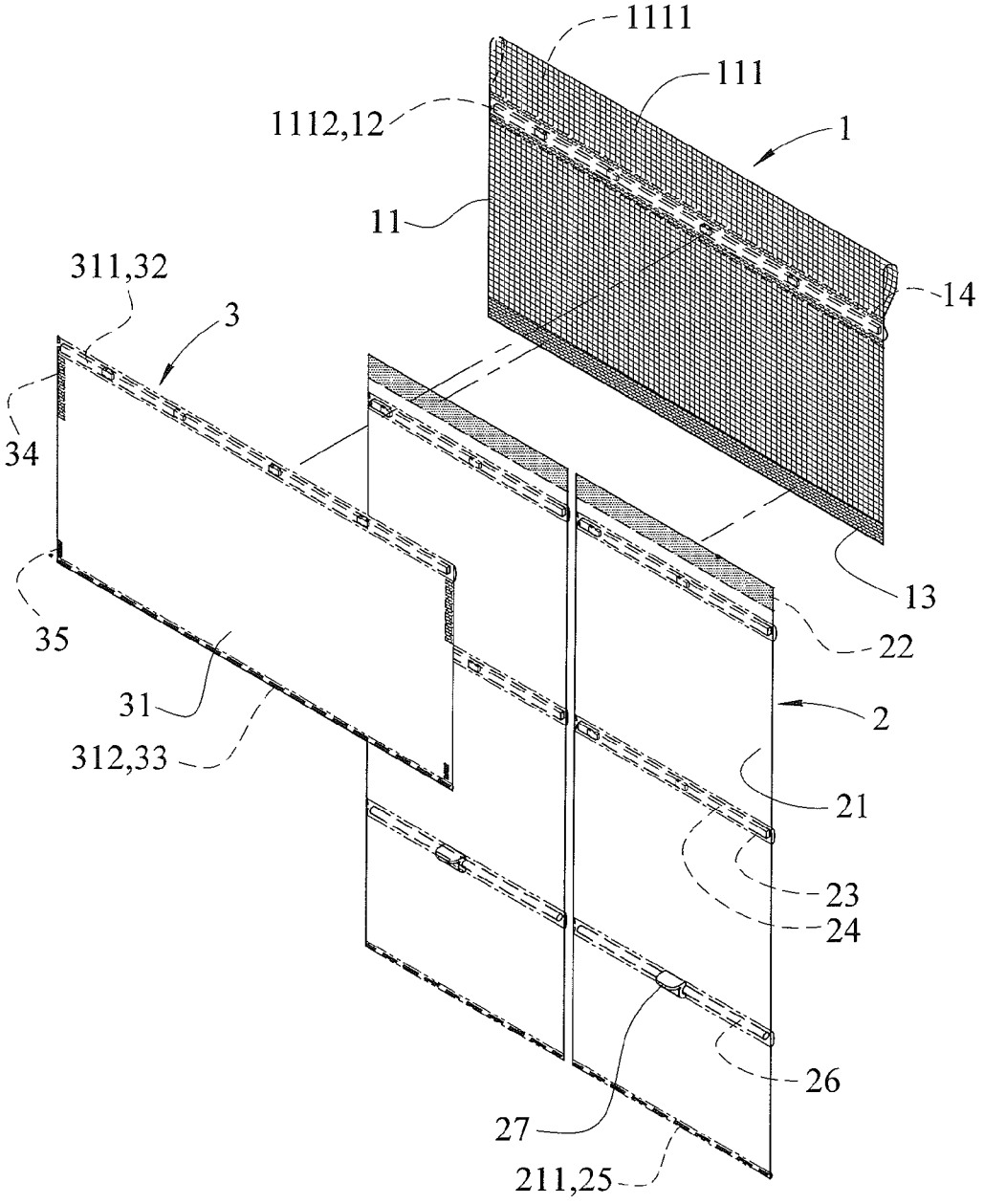
FIG. 2 is an exploded perspective view of the shade assembly in accordance with the first preferred embodiment of the present invention.

In the first mode, each of the first connecting member 13 and the second connecting member 14 of the first shading unit 1, and the at least one connecting member 34 of the third shading unit 3 is a loop tape or a hook tape, while each of the matching member 22 of each of the second shading units 2 and the at least one matching member 35 of the third shading unit 3 is a hook tape or a loop tape as shown in FIG. 2.

Figure 3:
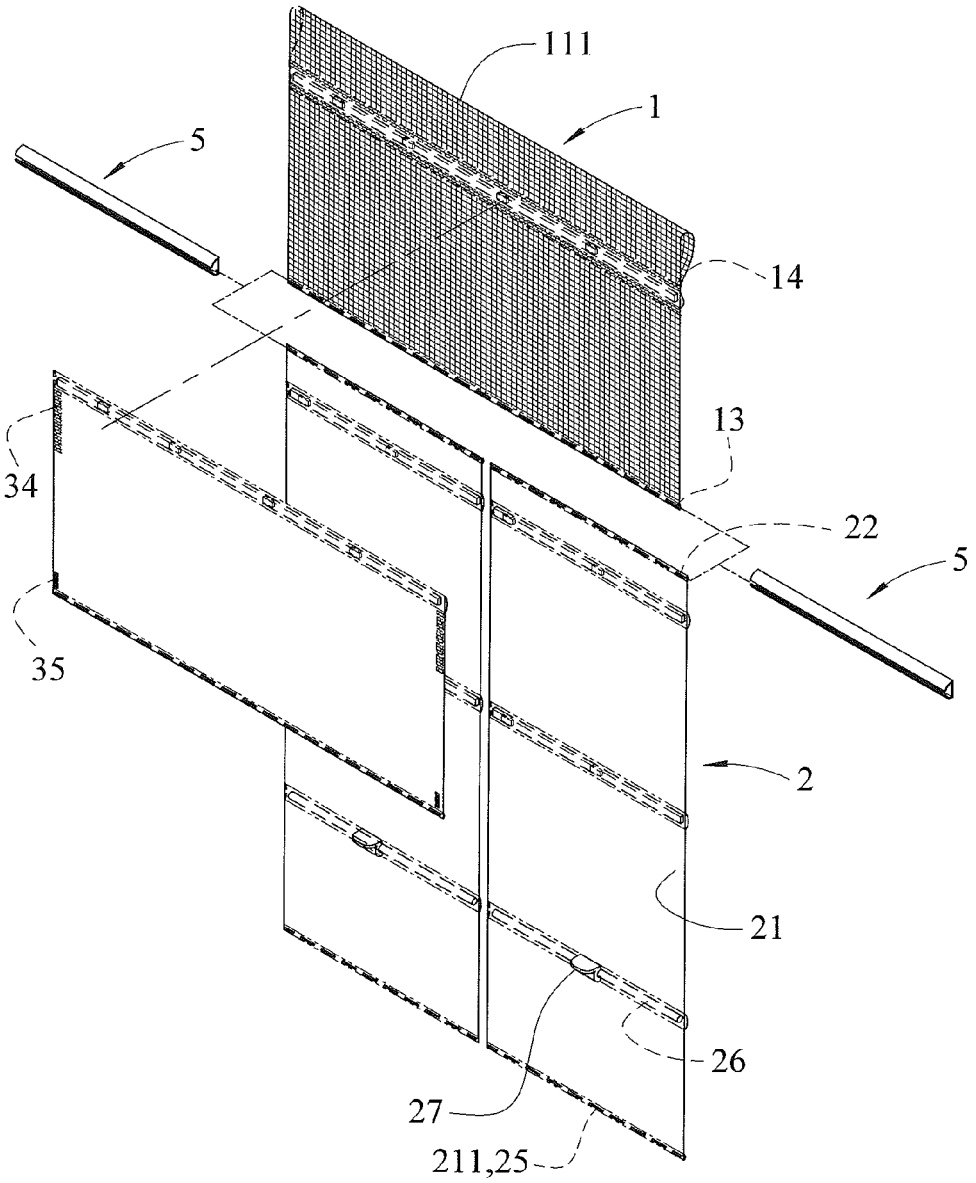
FIG. 3 is another exploded perspective view of the shade assembly in accordance with the first preferred embodiment of the present invention.
Figure 4:
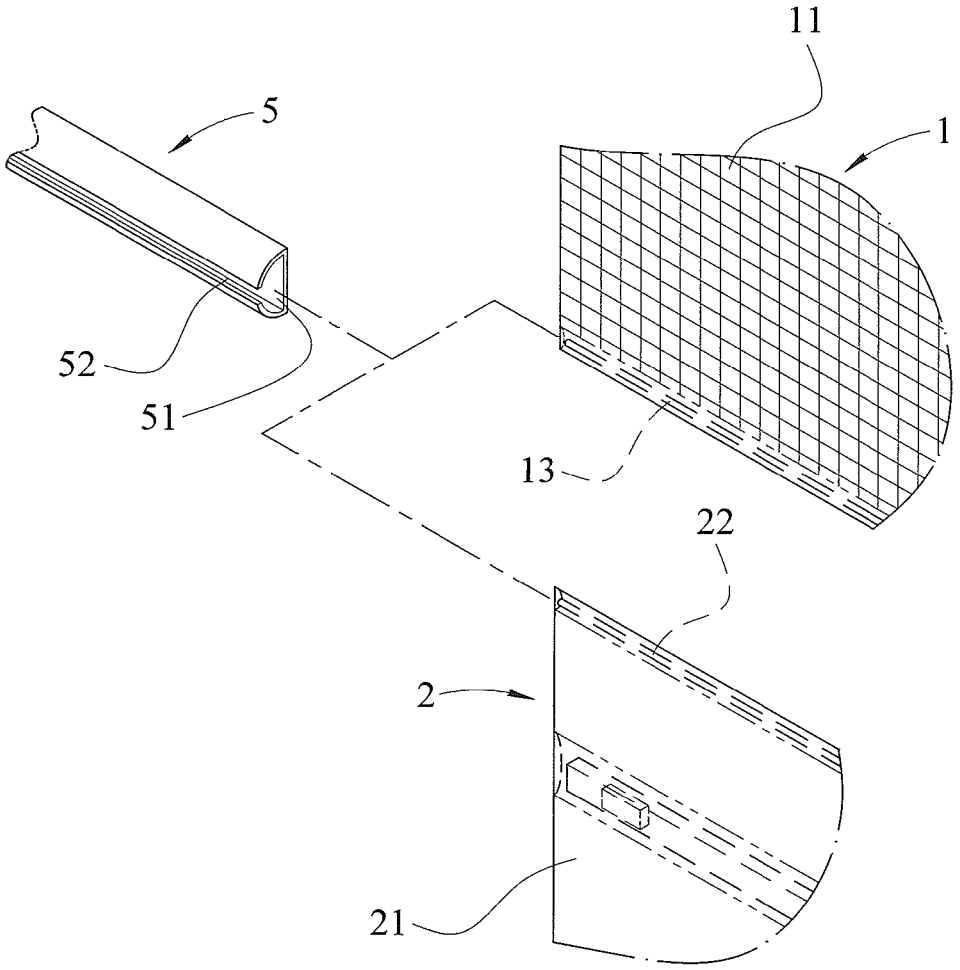
FIG. 4 is a locally enlarged view of the shade assembly as shown in FIG. 3.

In the second mode, each of the first connecting member 13 of the first shading unit 1 and the matching member 22 of each of the second shading units 2 is an elongate rod and is clamped in a clamping sleeve 5 as shown in FIGS. 3 and 4. The clamping sleeve 5 is C-shaped and defines a receiving channel 51 and a retaining slit 52. Thus, the first connecting member 13 of the first shading unit 1 and the matching member 22 of each of the second shading units 2 are received in the receiving channel 51 and limited by the retaining slit 52 of the clamping sleeve 5. In addition, each of the second connecting member 14 of the first shading unit 1 and the at least one connecting member 34 of the third shading unit 3 is a loop tape or a hook tape, while the at least one matching member 35 of the third shading unit 3 is a hook tape or a loop tape.

Referring to FIGS. 7-10, the shade assembly in accordance with the preferred embodiment of the present invention further comprises a fourth shading unit 4 detachably connected with the first shading unit 1 and arranged in rear of the second shading units 2. The fourth shading unit 4 is arranged at the bottom of the light permeation cloth 11 of the first shading unit 1 and includes a light permeation cloth 41 having a bottom provided with a tubular portion 411, a matching member 42 mounted on a top of the light permeation cloth 41 and detachably connected with the bottom of the light permeation cloth 11 of the first shading unit 1, and a weight pole 43 mounted in the tubular portion 411 of the light permeation cloth 41. The bottom of the light permeation cloth 41 is encircled and sewn to form the tubular portion 411.

In practice, the first shading unit 1, each of the second shading units 2, the third shading unit 3 and the fourth shading unit 4 are connected in two modes.

Figure 8:
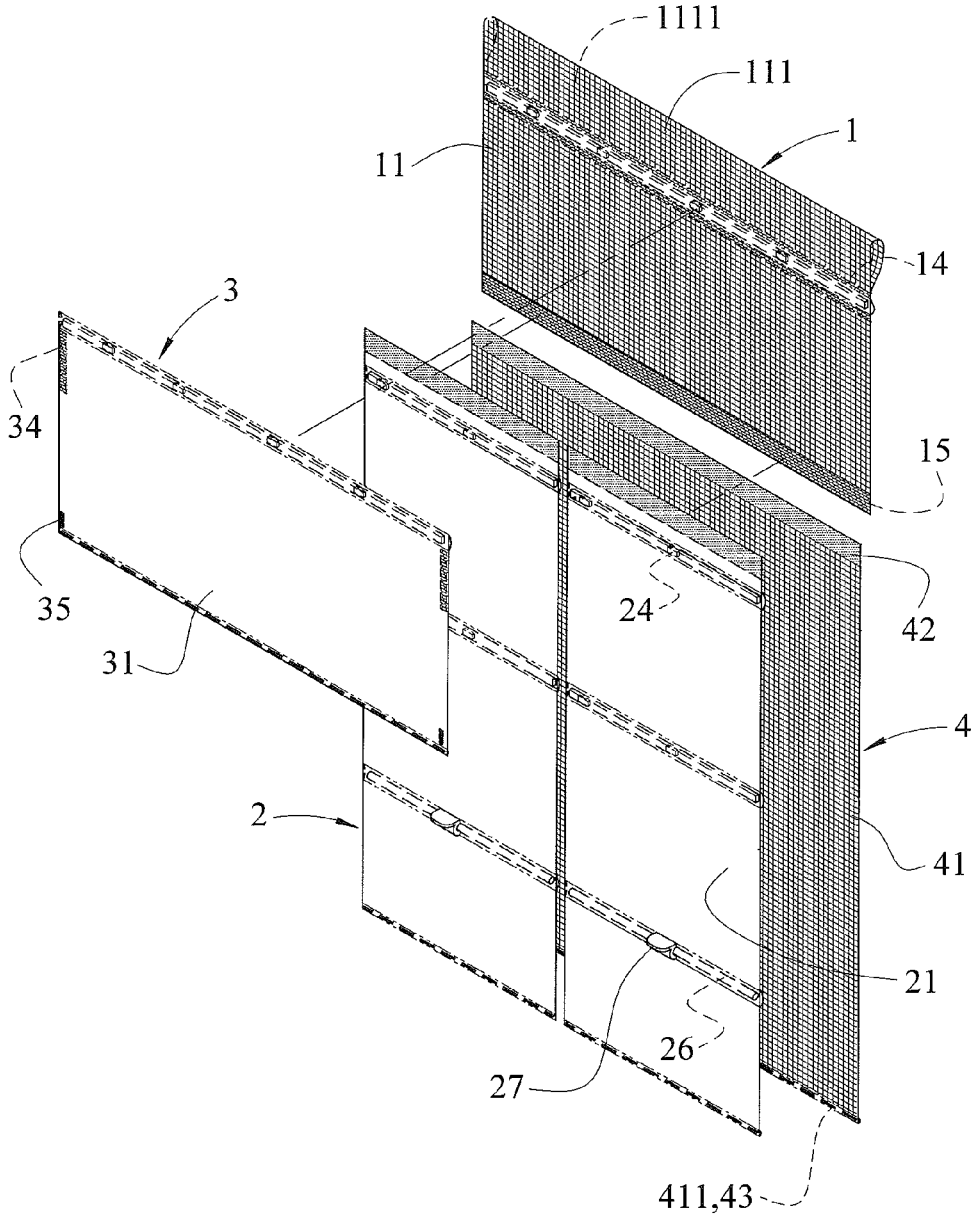
FIG. 8 is an exploded perspective view of the shade assembly in accordance with the second preferred embodiment of the present invention.

In the first mode, each of the first connecting member 13 and the second connecting member 14 of the first shading unit 1, and the at least one connecting member 34 of the third shading unit 3 is a loop tape or a hook tape, while each of the matching member 22 of each of the second shading units 2 and the at least one matching member 35 of the third shading unit 3 is a hook tape or a loop tape. The bottom of the light permeation cloth 11 has a rear face provided with a third connecting member 15, and the matching member 42 of the fourth shading unit 4 is connected with the third connecting member 15 of the first shading unit 1 in a sticking manner. The third connecting member 15 of the first shading unit 1 is a loop tape or a hook tape, while the matching member 42 of the fourth shading unit 4 is a hook tape or a loop tape as shown in FIG. 8.

Figure 9:
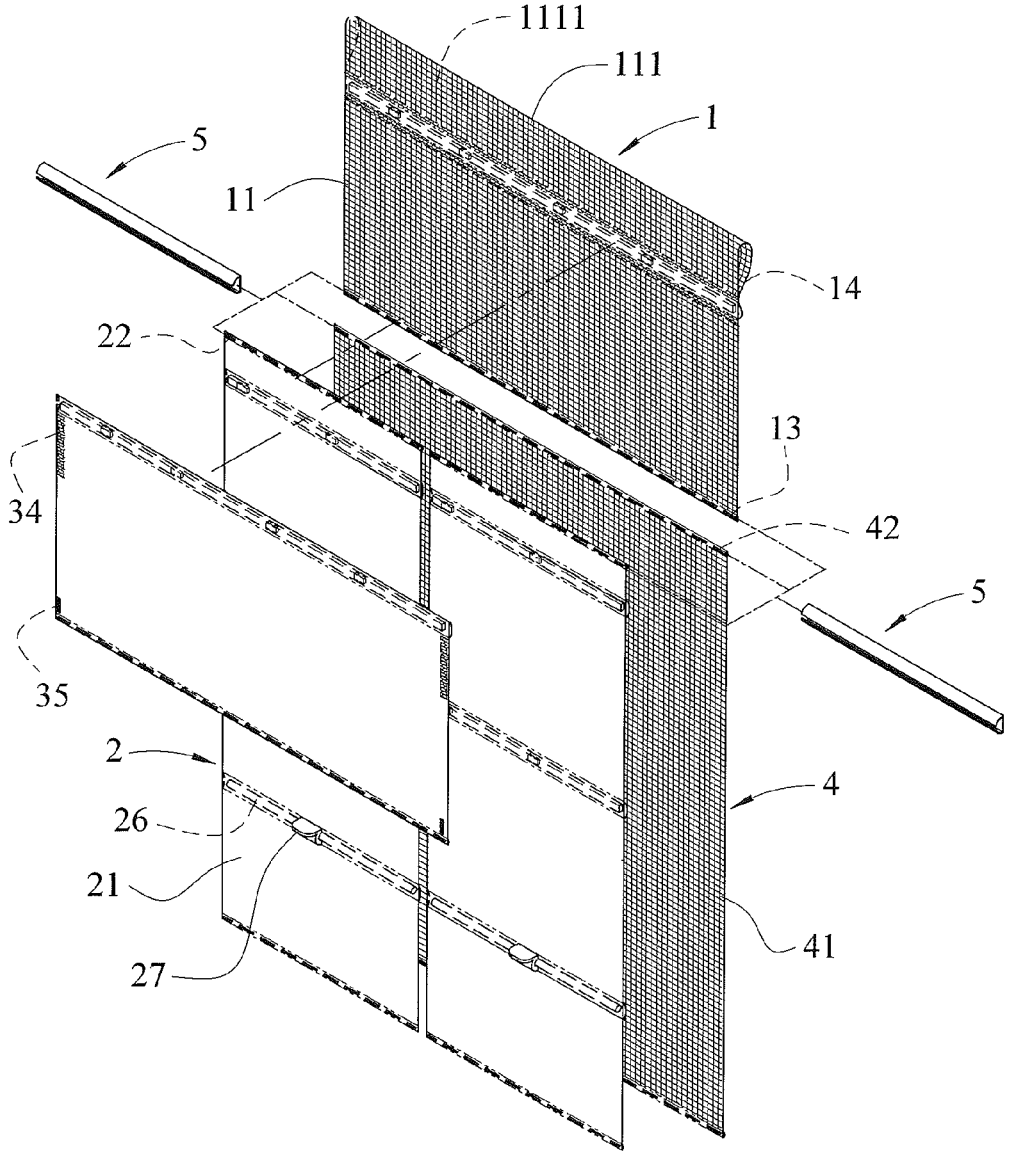
FIG. 9 is another exploded perspective view of the shade assembly in accordance with the second preferred embodiment of the present invention.
Figure 10:
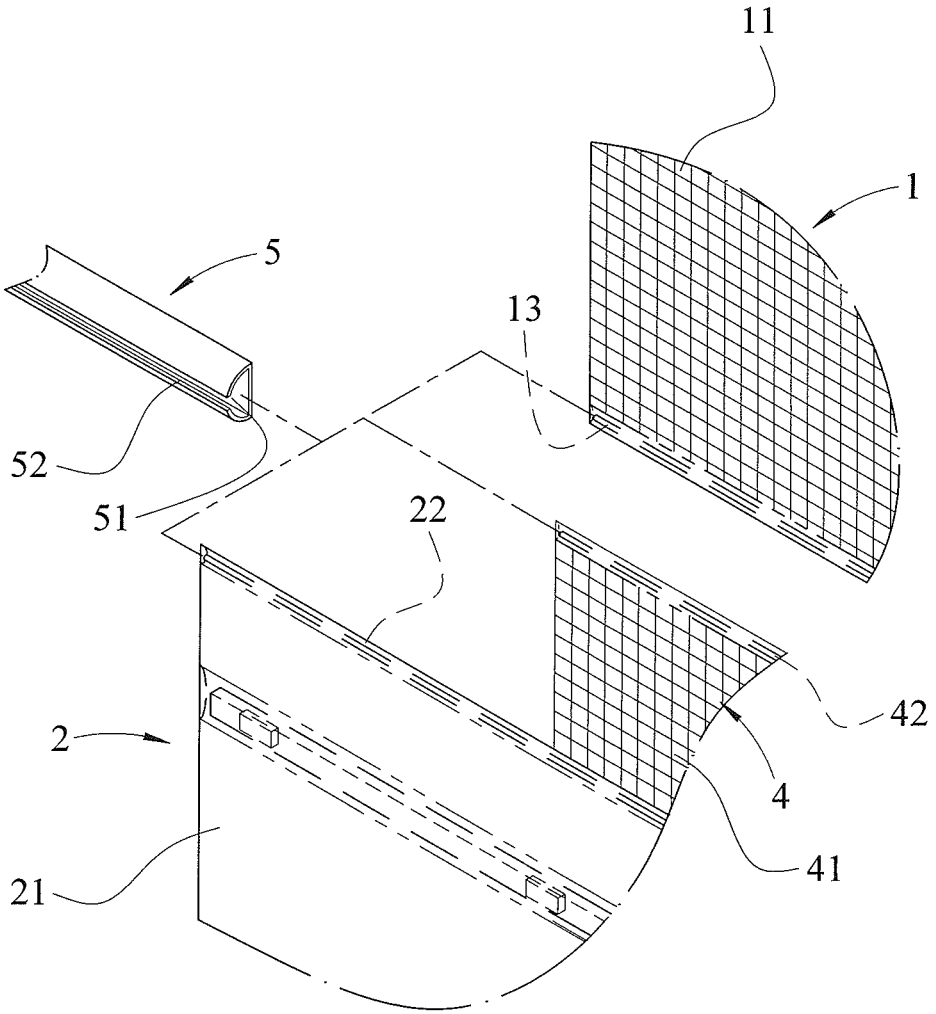
FIG. 10 is a locally enlarged view of the shade assembly as shown in FIG. 9.

In the second mode, each of the first connecting member 13 of the first shading unit 1, the matching member 22 of each of the second shading units 2 and the matching member 42 of the fourth shading unit 4 is an elongate rod and is clamped in a clamping sleeve 5 as shown in FIGS. 9 and 10. The clamping sleeve 5 is C-shaped and defines a receiving channel 51 and a retaining slit 52. Thus, the first connecting member 13 of the first shading unit 1, the matching member 22 of each of the second shading units 2 and the matching member 42 of the fourth shading unit 4 are received in the receiving channel 51 and limited by the retaining slit 52 of the clamping sleeve 5. In addition, the at least one connecting member 34 of the third shading unit 3 is a loop tape or a hook tape, while the at least one matching member 35 of the third shading unit 3 is a hook tape or a loop tape.

In assembly, the matching member 22 of each of the second shading units 2 is connected with the first connecting member 13 of the first shading unit 1, so that each of the second shading units 2 is arranged under the first shading unit 1. The magnet structure 32 of the third shading unit 3 is magnetically attracted with the magnet structure 12 of the first shading unit 1, so that the third shading unit 3 is located in front of the first shading unit 1 and arranged above the second shading units 2. The matching member 42 of the fourth shading unit 4 is connected with the third connecting member 15 of the first shading unit 1, so that the fourth shading unit 4 is arranged under the first shading unit 1 and juxtaposed to the second shading units 2.

Figure 11:
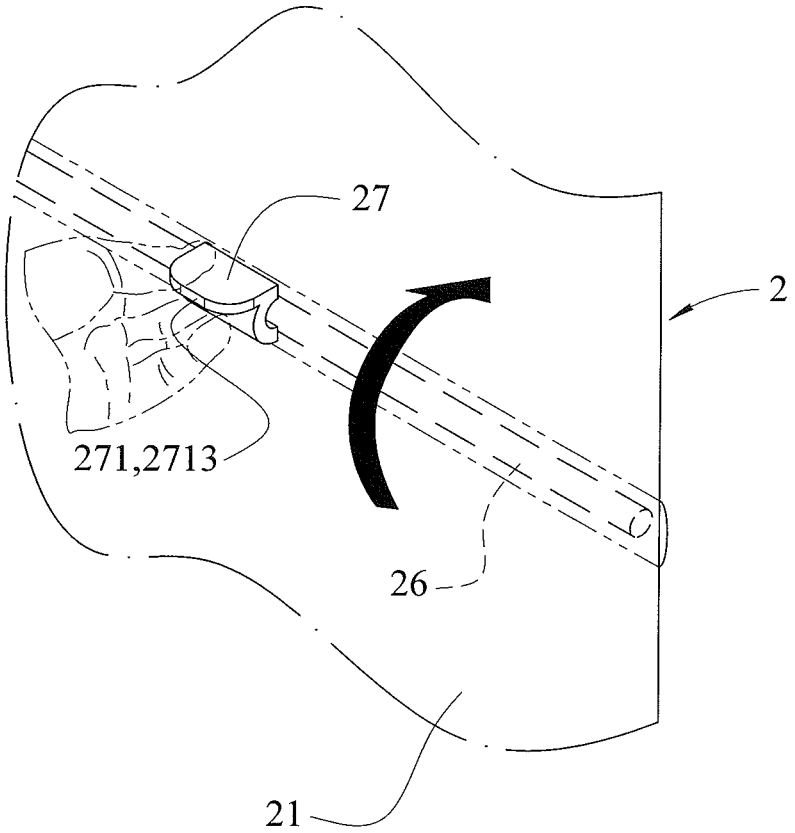
FIG. 11 is a schematic operational view of the adjusting structure of the shade assembly in accordance with the preferred embodiment of the present invention.
Figure 12:
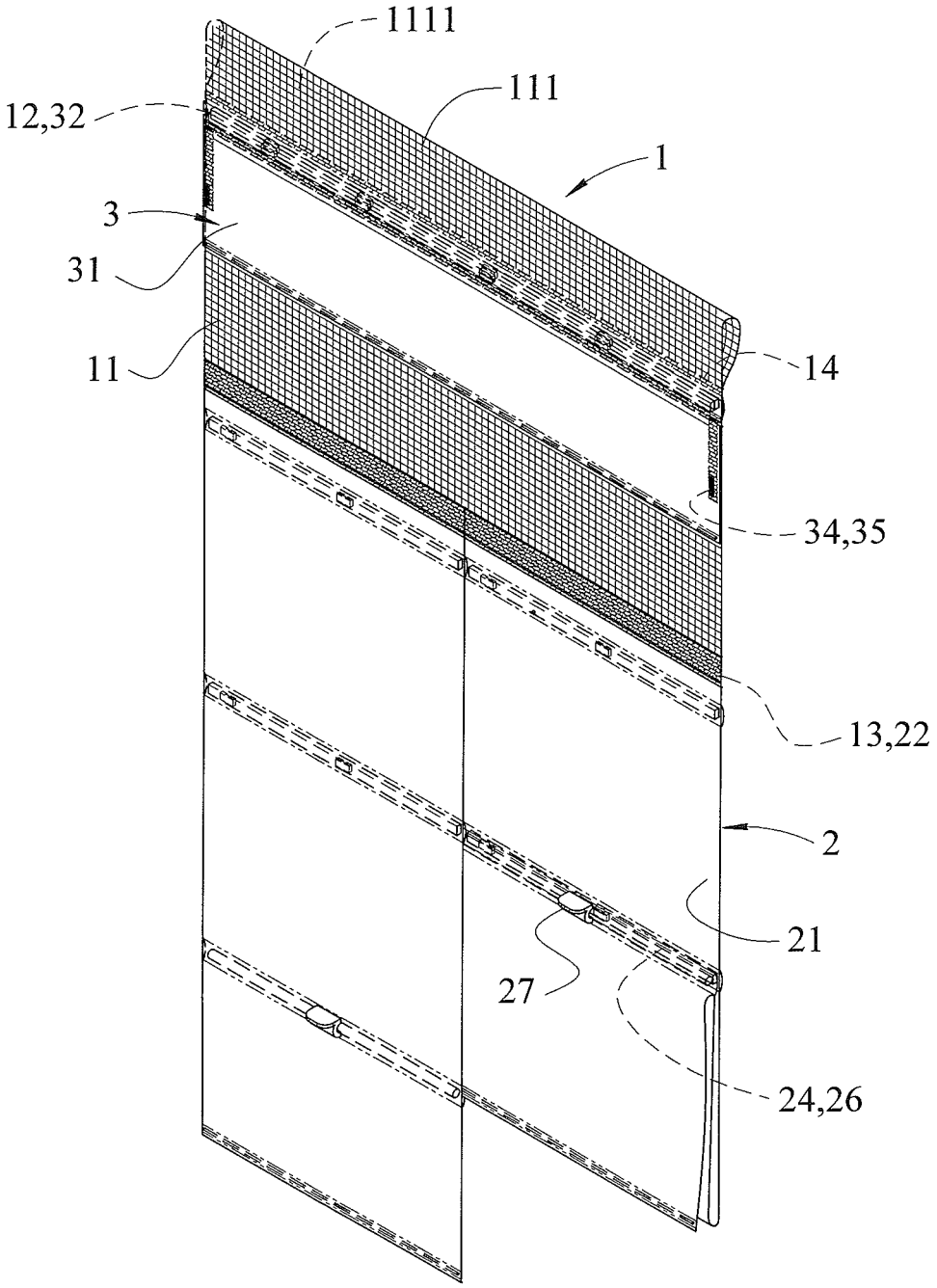
FIG. 12 is a schematic operational view of the shade assembly as shown in FIG. 1 in use.
Figure 13:
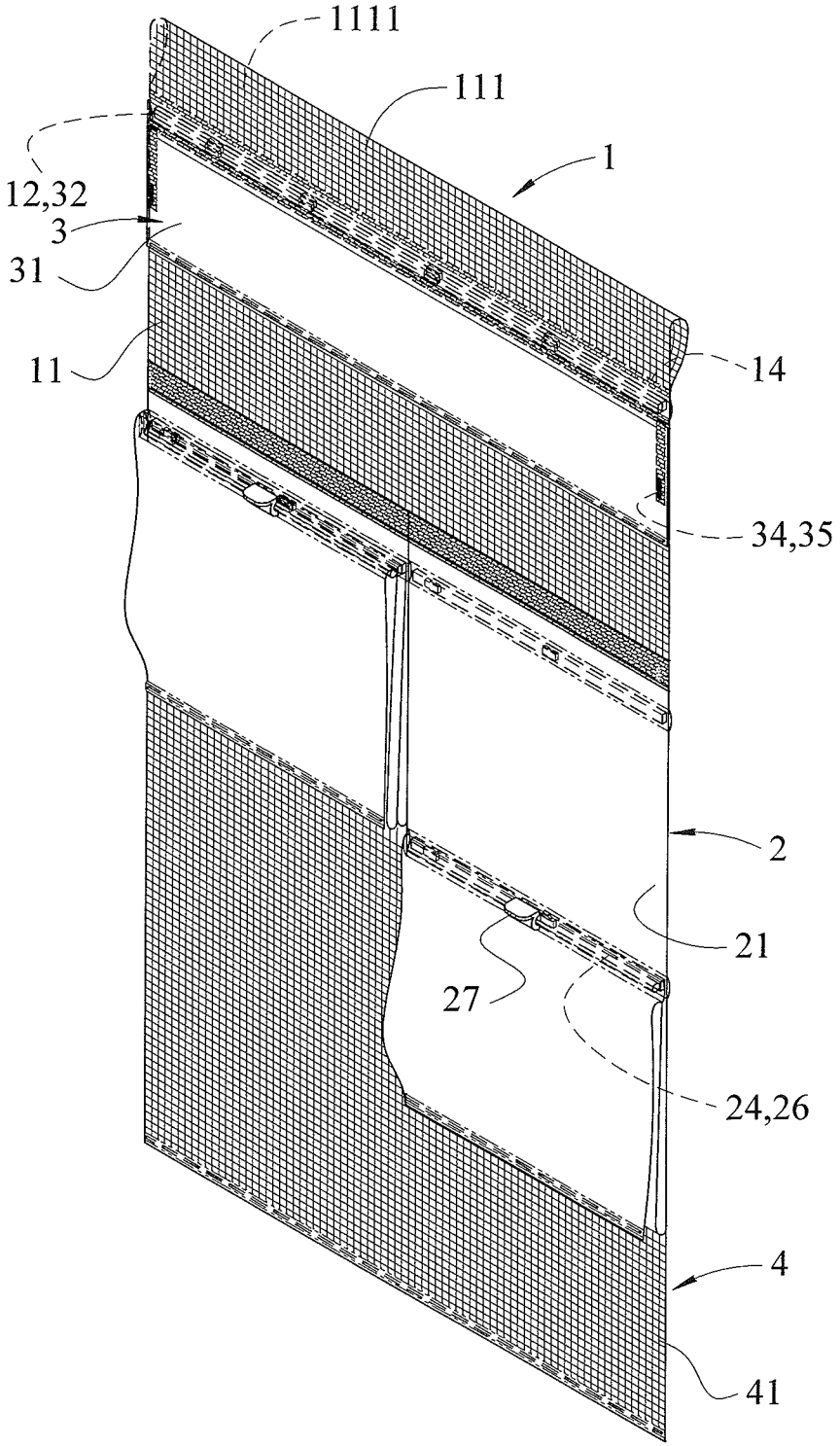
FIG. 13 is a schematic operational view of the shade assembly as shown in FIG. 7 in use.

In operation, referring to FIGS. 11-13 with reference to FIGS. 1-10, the first shading unit 1 is mounted on a door or window frame to attach the shade assembly to the door or window frame. In practice, when the door or window frame is provided with a support rod, the first mounting sleeve 1111 of the tubular portion 111 of the first shading unit 1 is mounted on the support rod of the door or window frame. Alternatively, when the door or window frame is provided with a connecting portion in the form of a hook tape or a loop tape, the second connecting member 14 of the first shading unit 1 is stuck to the connecting portion of the door or window frame.

When the extension 2713 of the adjusting structure 27 of each of the second shading units 2 is held and moved by a user's finger as shown in FIG. 11, the adjusting structure 27 of each of the second shading units 2 is moved upward, so that the metal element 26 is magnetically attracted by any one of the magnet structures 24 as shown in FIG. 12. In addition, the magnet structures 24 are magnetically attracted with each other. In such a manner, when the adjusting structure 27 of each of the second shading units 2 is moved upward, the metal element 26 is magnetically attracted by any one of the magnet structures 24, and the magnet structures 24 are magnetically attracted with each other, so that the shade cloth 21 of each of the second shading units 2 is folded upward. Thus, the shade cloth 21 of each of the second shading units 2 is partially folded, half folded or fully folded to adjust the incident sunlight so as to regulate the shading effect and the indoor brightness according to the user's requirement, thereby providing a comfortable sensation to the user.

As shown in FIG. 13, the shade cloth 21 of each of the second shading units 2 is folded upward to partially shade the light permeation cloth 41 of the fourth shading unit 4. In addition, the at least one matching member 35 of the third shading unit 3 is attached to the at least one connecting member 34, so that the shade cloth 31 of the third shading unit 3 is folded upward to partially shade the light permeation cloth 11 of the first shading unit 1. On the contrary, when the adjusting structure 27 of each of the second shading units 2 is moved downward, the metal element 26 is detached from the magnet structures 24, and the magnet structures 24 are detached from each other, so that the shade cloth 21 of each of the second shading units 2 is expanded downward. In addition, when the at least one matching member 35 of the third shading unit 3 is detached from the at least one connecting member 34, the shade cloth 31 of the third shading unit 3 is expanded downward to shade the light permeation cloth 11 of the first shading unit 1.

Accordingly, the shade cloth 21 of each of the second shading units 2 and the shade cloth 31 of the third shading unit 3 are expanded and folded to regulate the shading effect and the indoor brightness. In addition, the first shading unit 1, the second shading units 2, the third shading unit 3 and the fourth shading unit 4 can be detached from each other to facilitate the user respectively washing and cleaning the first shading unit 1, the second shading units 2, the third shading unit 3 and the fourth shading unit 4.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A shade assembly comprising:

a first shading unit;

at least one second shading unit detachably connected with the first shading unit; and a third shading unit detachably connected with the first shading unit;

wherein:

the first shading unit includes a light permeation cloth having a top provided with a tubular portion which has a first mounting sleeve and a second mounting sleeve, a magnet structure mounted in the second mounting sleeve, a first connecting member mounted on a bottom of the light permeation cloth, and a second connecting member mounted on a rear face of the light permeation cloth and corresponding to the second mounting sleeve of the tubular portion;

the at least one second shading unit includes a first shade cloth having a bottom provided with a tubular portion, a matching member mounted on a top of the first shade cloth and detachably connected with the first connecting member of the first shading unit, a plurality of mounting sleeves mounted on the first shade cloth and arranged under the matching member, a plurality of magnet structures mounted in the mounting sleeves respectively, a weight pole mounted in the tubular portion of the first shade cloth, and a metal element mounted in one of the mounting sleeves and arranged between the magnet structures and the weight pole;

the metal element is magnetically attracted by the magnet structures; and the third shading unit includes a second shade cloth having a top provided with a first tubular portion and a bottom provided with a second tubular portion, a magnet structure mounted in the first tubular portion of the second shade cloth and magnetically attracted with the magnet structure of the first shading unit, a weight pole mounted in the second tubular portion of the second shade cloth, at least one connecting member mounted on the top of the second shade cloth, and at least one matching member mounted on the bottom of the second shade cloth and detachably connected with the at least one connecting member.

2. The shade assembly of claim 1, wherein each of the magnet structures of the first shading unit, the at least one second shading unit and the third shading unit includes a housing, and at least one magnet mounted in the housing.

3. The shade assembly of claim 1, wherein:

the at least one second shading unit further includes an adjusting structure mounted on the first shade cloth and corresponding to the metal element;

the adjusting structure includes an adjusting piece arranged on a front face of the first shade cloth, two clamping pieces arranged on a rear face of the first shade cloth, and a plurality of fastening members extending through the two clamping pieces and the adjusting piece to combine the two clamping pieces with the adjusting piece;

the adjusting piece has a first end provided with an arcuate abutting portion resting on the metal element and a second end provided with an extension;

the adjusting piece is provided with a plurality of screw bores;

each of the two clamping pieces is provided with a plurality of through holes; and the fastening members extend through the through holes of the two clamping pieces and are screwed into the screw bores of the adjusting piece.

4. The shade assembly of claim 1, wherein each of the first connecting member and the second connecting member of the first shading unit, and the at least one connecting member of the third shading unit is a loop tape or a hook tape, and each of the matching member of the at least one second shading unit and the at least one matching member of the third shading unit is a hook tape or a loop tape.

5. The shade assembly of claim 4, further comprising:

a fourth shading unit detachably connected with the first shading unit and including a light permeation cloth having a bottom provided with a tubular portion, a matching member mounted on a top of the light permeation cloth and detachably connected with the bottom of the light permeation cloth of the first shading unit, and a weight pole mounted in the tubular portion of the light permeation cloth.

6. The shade assembly of claim 5, wherein:

the bottom of the light permeation cloth has a rear face provided with a third connecting member;

the matching member of the fourth shading unit is connected with the third connecting member of the first shading unit;

the third connecting member of the first shading unit is a loop tape or a hook tape; and the matching member of the fourth shading unit is a hook tape or a loop tape.

7. The shade assembly of claim 1, wherein:

each of the first connecting member of the first shading unit and the matching member of the at least one second shading unit is an elongate rod and is clamped in a clamping sleeve;

each of the second connecting member of the first shading unit and the at least one connecting member of the third shading unit is a loop tape or a hook tape; and the at least one matching member of the third shading unit is a hook tape or a loop tape.

8. The shade assembly of claim 7, wherein:

the clamping sleeve is C-shaped and defines a receiving channel and a retaining slit; and the first connecting member of the first shading unit and the matching member of the at least one second shading unit are received in the receiving channel and limited by the retaining slit of the clamping sleeve.

9. The shade assembly of claim 8, further comprising:

a fourth shading unit detachably connected with the first shading unit and arranged at the bottom of the light permeation cloth of the first shading unit.

10. The shade assembly of claim 9, wherein:

the fourth shading unit includes a light permeation cloth having a bottom provided with a tubular portion, a matching member mounted on a top of the light permeation cloth, and a weight pole mounted in the tubular portion of the light permeation cloth;

the matching member of the fourth shading unit is an elongate rod and is clamped in the clamping sleeve; and the matching member of the fourth shading unit is received in the receiving channel and limited by the retaining slit of the clamping sleeve.

* * * * *